United States Patent [19]

Goodman

[11] Patent Number: 4,869,449

[45] Date of Patent: Sep. 26, 1989

[54] LOCKABLE GUN SAFETY DRAWER

[76] Inventor: Mark L. D. Goodman, P.O. Box 1413, Boise, Id. 83701

[21] Appl. No.: 273,976

[22] Filed: Nov. 21, 1988

[51] Int. Cl.[4] ..... A47B 96/06

[52] U.S. Cl. ..... 248/205.1; 5/503; 5/308; 5/508

[58] Field of Search ..... 248/205.1; 5/503, 507, 5/508, 308, 58

[56] References Cited

U.S. PATENT DOCUMENTS

| | | | |
|---|---|---|---|
| 1,423,804 | 7/1922 | Kontorowitz | 5/308 |
| 2,643,397 | 6/1953 | Ehrenreich et al. | 5/507 |
| 4,691,396 | 9/1987 | Hoffman | 5/503 |
| 4,788,838 | 12/1988 | Cislo | 5/507 X |

FOREIGN PATENT DOCUMENTS

| | | | |
|---|---|---|---|
| 599252 | 6/1934 | Fed. Rep. of Germany | 5/308 |

*Primary Examiner*—Blair M. Johnson

*Attorney, Agent, or Firm*—Frank J. Dykas; Craig M. Korfanta

[57] ABSTRACT

A lockable gun safety drawer 10 having a gun drawer 11 slidably engaged with a recessed drawer housing 12 which can be attached to the underside of bed 1. Recessed housing 12 has top plate 19 having a bedside bracket 20 extending upwardly from its front edge. Bedside bracket 12 is configured to be received between an angle iron bed frame member 4 and a bottom edge of the bed's box springs. Top plate 19 is further provided with bracket 16 at its back edge for securing the same to the underside of the box springs 3 or a wooden bed slat 5. Recessed drawer housing 12 is constructed of top plate 19, side panels 20 and 21, back panel 23 and bottom panel 24. Holster post 15 is attached to and extends upwardly from bedside bracket 16 and is adapted to hold a holstered gun 6 in a ready position at bedside.

1 Claim, 3 Drawing Sheets

LOCKABLE GUN SAFETY DRAWER

BACKGROUND OF THE INVENTION

1. Technical Field

This invention generally relates to safe storage devices for guns and in particular to a lockable drawer for storing a hand gun beneath a bed.

2. Background Art

Due to high incidents of residential burglary, there is a growing trend to arm oneself for protection against an intruder. As a result, several apparati have been devised which hold a holstered hand gun in a ready position at bedside. EDDY, U.S. Pat. No. 4,483,501, JONES, U.S. Pat. No. 4,466,148 and KEENAN, U.S. Pat. No. 4,461,442, all disclose similar devices for holding a hand gun at bedside. The devices are all held in place by a member extending between the box spring and mattress. CROSS, U.S. Pat. No. 1,969,258, teaches a holster and bracket which possibly could be adapted to be held at bedside.

The fall, 1988, addition of *Hold Everything,* a catalog of household ideas by William-Sonoma teaches an under bed storage system having plastic drawers installed on steel runners secured to the bottom of a bed. Drawers are not lockable nor are they adapted to hold a holstered hand gun in a ready position. A similar device is taught by FISHER, ET AL., U.S. Pat. No. 2,673,601, which teaches a portable ashtray having a "drawer". The ashtray is securable to the underside of a chair or table by a strapping member and hooks. The securing means of Fisher, et al. is not well suited for attachment to the underside of a bed, as the metal angle iron bed frame members cannot be hooked into. Additionally, the "drawer" of Fisher, et al. is not readily adapted to hold a holstered gun in a ready position at bedside.

What is needed is a lockable, recessed drawer which is easily attached to the underside of a bed and which also provides a means for holding a holstered hand gun in a ready position at bedside. Accordingly, it is an object of the present invention to provide a lockable, recessed drawer for safe storage of a hand gun, and at the same time providing a holster post for holding a holstered gun in a ready position at bedside.

DISCLOSURE OF INVENTION

These objects are accomplished by a lockable gun safety drawer. A gun drawer is slidably engaged with a recessed housing which can be attached to the underside of a bed. The recessed housing has a top plate having a bedside bracket extending upwardly from its front side. The bedside bracket is configured to be received between an angle iron bed frame member and a bottom edge of the bed's box springs. The top plate is further provided with a bracket at its back edge for securing the same to the underside of the box springs or a wooden bed slat. The recessed drawer housing is defined by the top plate, side panels, back panel and bottom panel. The side panels and back panel extend downward from the bottom side of the top plate and have the bottom panel attached thereto. The side panels, back panel and bottom panel are all disposed to define a recessed housing for receiving the gun drawer. A holster post is attached to and extends upwardly from the bedside bracket and is adapted to hold a holstered gun in a ready position at bedside.

BEST MODE FOR CARRYING OUT INVENTION

Figure 1:
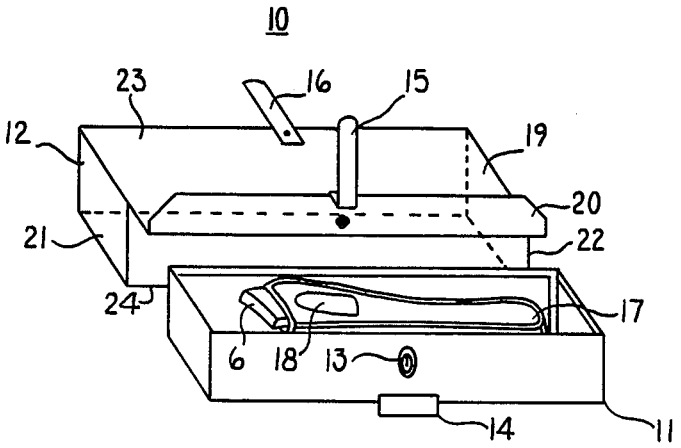
FIG. 1 is a three-quarter perspective view of a lockable gun safety drawer.
Figure 2:
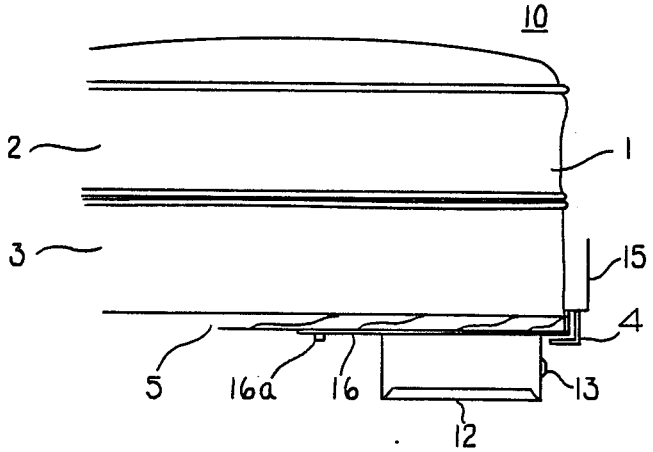
FIG. 2 is a side view of a lockable gun safety drawer.

Lockable gun safety drawer 10 is shown in FIG. 1 having gun drawer 11 separated from recessed drawer housing 12 and holding holster 17. Gun drawer 11 is provided with a lock 13, facilitating locked storage of a hand gun. Drawer handle 14 is attached to the lower edge of front drawer 11 and provides a convenient hand hold for sliding the gun drawer 11 in and out of recessed drawer housing 12. Recessed drawer housing 12, constructed from left side panel 21, right side panel 22, and back side panel 23 all attached to the underside of top plate 19. Bottom panel 24 is attached to left side panel 21, right side panel 22, and back side panel 23. Panels 21, 22, 23 and 24 are all advantageously disposed so as to form a recessed drawer housing 12 such that the recessed drawer housing will not interfere with an angle iron perimeter frame member 4 as is shown in FIG. 2.

Bedside bracket 20 is attached to the front edge of top panel 16 and extends perpendicularly upward therefrom. Bedside bracket 20 and top plate 16 define an L-shaped member for insertion between angle iron frame member 4 and the bottom side edge of box spring 3. Bracket 16 is attached to the back edge of top plate 19 and provides an attachment point for attaching top plate 19 to the underside of box springs 3 or wooden slat 5.

Figure 3:
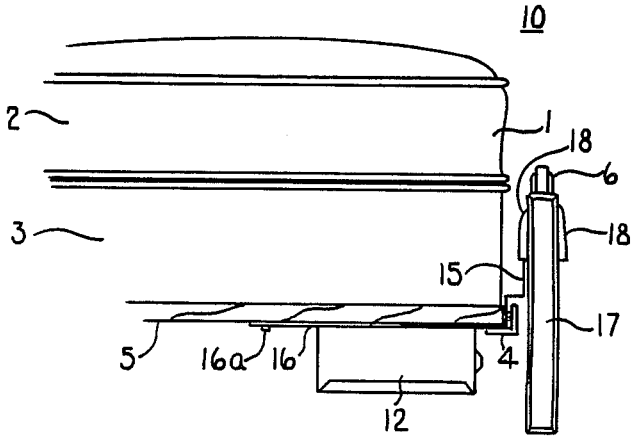
FIG. 3 is a side view of a lockable gun safety drawer holding a holstered gun in a ready position.
Figure 4:
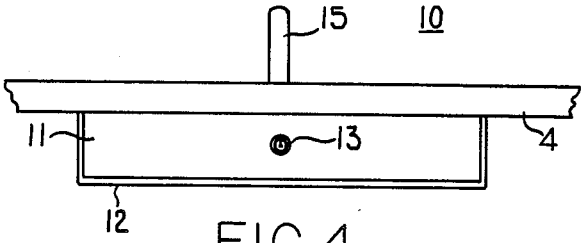
FIG. 4 is a front view of a lockable gun safety drawer and an angle iron frame member.

Holster post 15 is attached to bedside bracket 20 and provides a means for holding a holstered gun in a ready position at bedside, as is shown in FIG. 3. Holster 17 is provided with a pair of holster post receiving pockets 18 for receiving holster post 15 and holding holster 17. Holster 17 is advantageously provided with holster receiving pockets 18 on both sides. In this manner, holster 17 can be positioned for either right or left handed users depending upon the side of the bed and the position of the user. FIG. 4 shows holster post 15 extending upwardly and outward of angle iron frame member 4.

Figure 5:
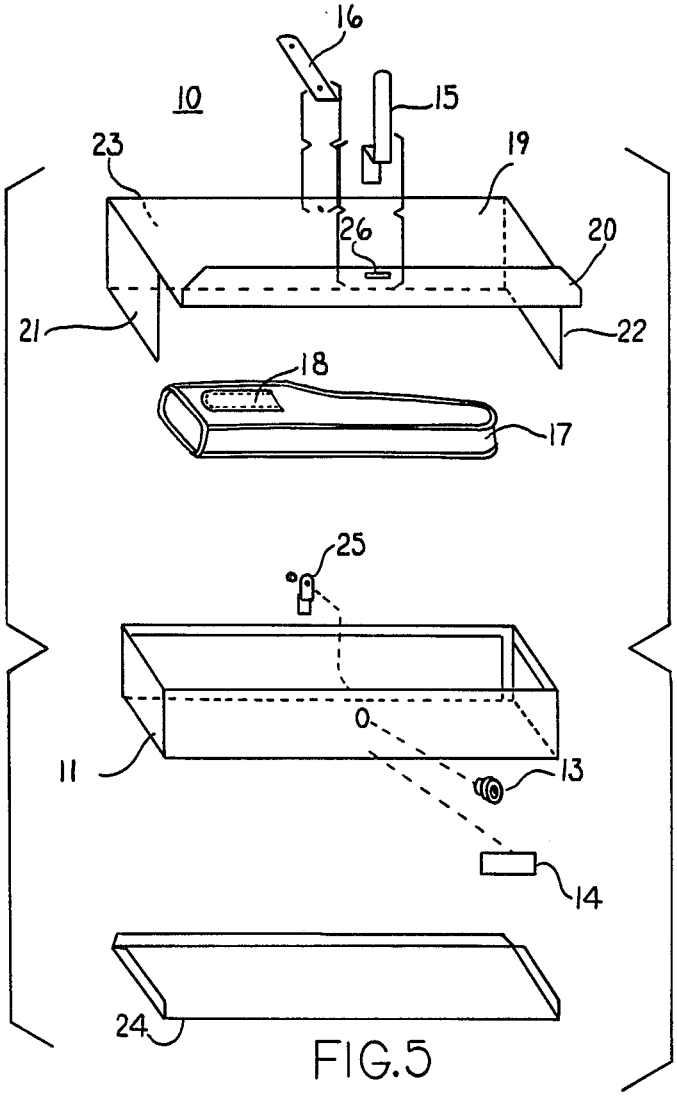
FIG. 5 is an exploded perspective view of a gun safety drawer.

Referring now to FIG. 5 the various components of lockable gun safety drawer 10 are shown in an exploded view. Top plate 19 is provided with a lock dog slot 26 for receiving the lock dog 25 of lock 13 for locking the drawer in a closed position.

In use, lockable gun safety drawer 10 is installed at the underside of bed 1 and hand gun 6 is locked within a gun drawer 11 and recessed housing 12. Upon retiring, the user can unlock drawer 11 and place holster 17 and gun 6 on holster post 15 in the ready position. The orientation of the gun handle of gun 6 can be conveniently placed depending upon the user. Assuming a safe night's sleep, upon awakening the user can then remove gun 6 and holster 17 from holster post 15 and place them back in locked storage in gun drawer 11 and recessed drawer housing 12 preventing unauthorized use.

While there is shown and described the present preferred embodiment of the invention, it is to be distinctly understood that this invention is not limited thereto but may be variously embodied to practice within the scope of the following claims.

I claim:

1. A lockable gun safety drawer for use with a bed having a mattress and box springs supported by perimeter angle iron frame members, comprising:

a top plate for attachment to the underside of the box springs, said top plate further having a bedside bracket extending upwardly from the front edge of said top plate to define an L-shaped member for insertion between the angle iron frame member and the bottom side edge of the box spring;

bracket means for attaching the back edge of said top plate to the underside of the box springs;

a recessed drawer housing having bottom, side and back panels defining a rectangular enclosure for slidably receiving a gun drawer, said enclosure attached to the underside of the top plate at a recess position so as to extend down from the top plate, behind the angle iron frame member;

a gun drawer for slidable engagement with said recessed drawer housing;

a holster post attached to and extending upwardly from said bedside bracket for holding a holstered gun in a ready position; and locking means attached to said drawer for locking said drawer in said recessed drawer housing.

* * * * *

UNITED STATES PATENT AND TRADEMARK OFFICE

CERTIFICATE OF CORRECTION

PATENT NO. : 4,869,449

DATED : September 26, 1989

INVENTOR(S) : Goodman

It is certified that error appears in the above-identified patent and that said Letters Patent is hereby corrected as shown below:

The title page should be deleted to appear as per attached title page.

Signed and Sealed this

Nineteenth Day of March, 1991

*Attest:*

HARRY F. MANBECK, JR.

*Attesting Officer*

*Commissioner of Patents and Trademarks*

United States Patent [19]

Goodman

[11] Patent Number: 4,869,449

[45] Date of Patent: Sep. 26, 1989

[54] LOCKABLE GUN SAFETY DRAWER

[76] Inventor: Mark L. D. Goodman, P.O. Box 1431, Boise, Id. 83701

[21] Appl. No.: 273,976

[22] Filed: Nov. 21, 1988

[51] Int. Cl.[4] ..... A47B 96/06

[52] U.S. Cl. ..... 248/205.1; 5/503; 5/308; 5/508

[58] Field of Search ..... 248/205.1; 5/503, 507, 5/508, 308, 58

[56] References Cited

U.S. PATENT DOCUMENTS

| | | | |
|---|---|---|---|
| 1,423,804 | 7/1922 | Kontorowitz | 5/308 |
| 2,643,397 | 6/1953 | Ehrenreich et al. | 5/507 |
| 4,691,396 | 9/1987 | Hoffman | 5/503 |
| 4,788,838 | 12/1988 | Cislo | 5/507 X |

FOREIGN PATENT DOCUMENTS

| | | | |
|---|---|---|---|
| 599252 | 6/1934 | Fed. Rep. of Germany | 5/308 |

*Primary Examiner*—Blair M. Johnson

*Attorney, Agent, or Firm*—Frank J. Dykas; Craig M. Korfanta

[57] ABSTRACT

A lockable gun safety drawer 10 having a gun drawer 11 slidably engaged with a recessed drawer housing 12 which can be attached to the underside of bed 1. Recessed housing 12 has top plate 19 having a bedside bracket 20 extending upwardly from its front edge. Bedside bracket 12 is configured to be received between an angle iron bed frame member 4 and a bottom edge of the bed's box springs. Top plate 19 is further provided with bracket 16 at its back edge for securing the same to the underside of the box springs 3 or a wooden bed slat 5. Recessed drawer housing 12 is constructed of top plate 19, side panels 20 and 21, back panel 23 and bottom panel 24. Holster post 15 is attached to and extends upwardly from bedside bracket 16 and is adapted to hold a holstered gun 6 in a ready position at bedside.

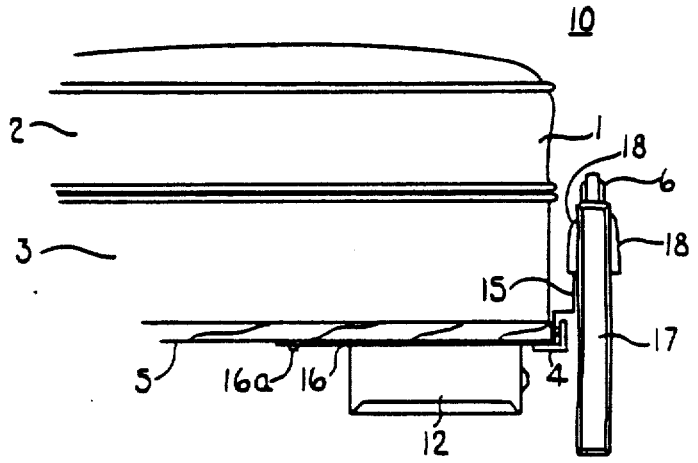

1 Claim, 3 Drawing Sheets